US005103125A

United States Patent [19]

Ogden

[11] Patent Number: 5,103,125

[45] Date of Patent: Apr. 7, 1992

[54] ELECTRONIC CONTROL ADAPTER FOR MECHANICAL THROTTLE CONTROL

[76] Inventor: Ronald H. Ogden, HC-2 Box 7876, Anza, Calif. 92306

[21] Appl. No.: 387,070

[22] Filed: Jul. 28, 1989

[51] Int. Cl.[5] ..... F02D 41/04

[52] U.S. Cl. ..... 310/72; 123/399; 338/180

[58] Field of Search ..... 123/361, 399; 307/9.1, 307/10.1; 310/71, 72; 318/514, 687; 338/133, 144, 150, 176, 180, 194

[56] References Cited

U.S. PATENT DOCUMENTS

| | | | |
|---|---|---|---|
| 2,807,695 | 9/1957 | Delmonte | 338/150 |
| 2,841,675 | 7/1958 | Oestreicher | 338/150 |
| 3,225,853 | 12/1965 | Norton et al. | 338/133 |
| 3,981,618 | 9/1976 | Nelson, Jr. | 417/34 |
| 4,831,985 | 5/1989 | Mabee et al. | 123/399 |

FOREIGN PATENT DOCUMENTS

| | | | |
|---|---|---|---|
| 234213 | 5/1925 | United Kingdom | 338/150 |

*Primary Examiner*—Steven L. Stephan
*Assistant Examiner*—D. L. Rebsch
*Attorney, Agent, or Firm*—Baker, Maxham, Jester & Meador

[57] ABSTRACT

An adapter for a mechanical throttle control to provide electrical signals to an electronic control for an engine. A mechanical vernier throttle control unit for converting rotational motion to linear motion is coupled directly to a potentiometer, the tap output of which is connected to the electronic control. Linear motion of the control unit is directly imparted to the potentiometer to provide engine speed signals to the engine through the electronic control module.

5 Claims, 2 Drawing Sheets

ELECTRONIC CONTROL ADAPTER FOR MECHANICAL THROTTLE CONTROL

FIELD OF THE INVENTION

This invention relates generally to controls for engines and more particularly concerns a mechanic throttle control adapter for controlling electronic engine controls, primarily for engines used for fire service.

BACKGROUND OF THE INVENTION

A large number of fire engines now incorporate electronic controls and more specifically, electronic controls for determining the speed of the engine during pumping service where that control is handled externally from the pump control panel. Presently a Morse or Felsted control is used whereby rotary motion is mechanically converted to linear motion, that control being mounted on the control panel. The term "Morse control" will be used hereinafter to refer to both such controls and any other equivalent. The portion of the Morse control extending inwardly from the panel couples to a throttle cable, which cable then connects at some previously thought-to-be convenient point to a potentiometer, the output of which is connected to the electronic control for controlling the speed of the engine. The electronic control normally is mounted in the cab of the fire truck and the pump control panel is mounted on the body some distance rearwardly from the electronic control. The throttle cable coupled to the Morse control is normally housed within a sheath made of plastic or similar material and extends approximately ten feet within the sheath from the interior end of the Morse control to the vicinity of the potentiometer. Because of the need to attach the cable to the potentiometer cable, a splice is necessary. The potentiometer has been located at some point remote from the pump control panel, between that and the electronic control in the fire truck cab.

The Morse control itself is a readily available component which may be termed a mechanical vernier throttle control unit. Rotating the external control knob counterclockwise causes linear motion of an inwardly projecting rod having a connector such as a ball on the innermost end of the rod to move outward. When the proper engine speed is achieved, the Morse control stays positively fixed at that position. It may be released by rotating the control knob in the opposite direction and it has the feature of a pop-release, whereby hitting the release button at the center of the external control knob causes the central rod to move rapidly to its home position which is minimum throttle position for the engine.

One of the problems relating to the prior structure of connecting a cable from the Morse control to a potentiometer at some location between the Morse control and the electronic control on the engine is that it requires mechanical attachments and a run of cable. These are mechanical means which are subject to failure. It is also difficult to achieve any precision of control with such a device. However, this structure has been used and has been relatively satisfactory and was devised and accepted by engineers of major fire engine manufacturers, since no other means has been available up to the present time.

SUMMARY OF THE INVENTION

A primary purpose of this invention is to employ the operation of the Morse control head with a potentiometer directly connected to it so that external operation of the engine speed control on a pump control panel is exactly the same as it is with the present device but it has the improvements of direct and precise control of engine speed. In other words, the ball connection used in these throttle controls can be connected directly to the potentiometer eliminating a run of cable with attendant brackets, splices and pivot blocks. With this invention, on present installations all the cable linkage, etc., can be removed and the potentiometer installed directly to the Morse controls completely removing these problem areas.

Broadly speaking, the invention comprises a device for converting the linear motion of the Morse control to changes in the electrically tapped position of a potentiometer, thereby applying modifying signals to the electronic control for directly controlling the engine speed. The potentiometer of the invention comprises a spring biased core and a fixed tap mounted to a housing, which housing is mounted to the interior end of the Morse control. The linearly movable element of the Morse control is coupled to the movable core of the potentiometer and moves directly therewith. By having only electrically conducting wires and not mechanical cables extending from the Morse control/potentiometer combination to the engine electronic control, the inefficiencies of the prior art are overcome. By this means, linear motion created by adjustments to the Morse control are mechanically directly coupled to the potentiometer, the output of which is a selectively modified electrical signal and after initial setting, needs no further adjustment.

Alternatively, the potentiometer tap could be connected to the linearly movable device coupled to the Morse control and the potentiometer core could be fixed within its housing.

BRIEF DESCRIPTION OF THE DRAWING

The objects, advantages and features of the invention will be more readily perceived from the following detailed description when read in conjunction with the accompanying drawing, in which.

DESCRIPTION OF THE PREFERRED EMBODIMENTS

Figure 1:
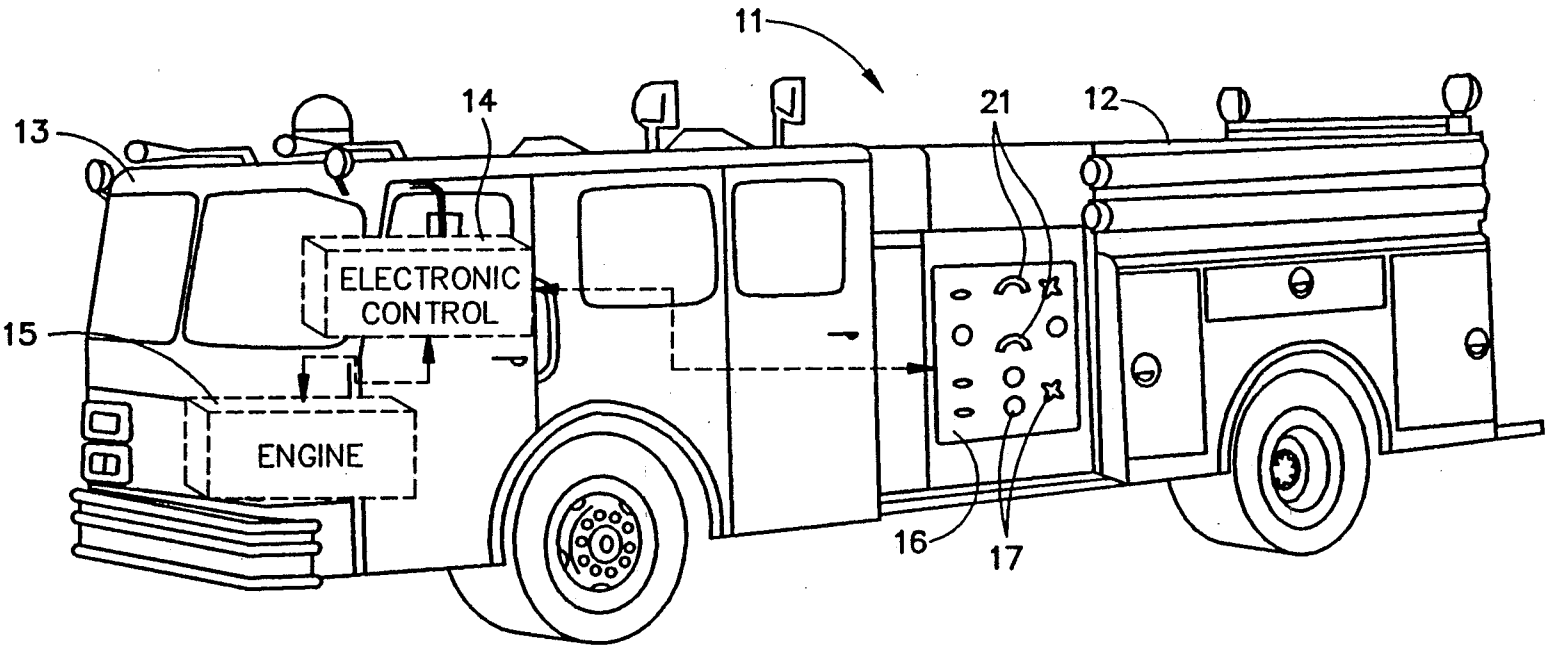
FIG. 1 is a partially schematic view of a fire truck showing the basic control elements in block form.

With reference now to the drawing, and more particularly to FIG. 1 thereof, there is shown fire truck 11 comprising body 12, cab 13 with electronic control module 14 located therein and engine 15 positioned within the forward end of the cab in normal configuration. Of course, it is possible that the engine may be located at other positions such as under or behind the seats and the electronic control module is always located on the frontal upper portion of the engine. On the side of body 12 is pump control panel 16 having a number of manually operable control knobs 17 and gauges 21. There are other elements of the control panel which are not relevant to this invention but are relatively standard for fire fighting equipment.

Figure 2:
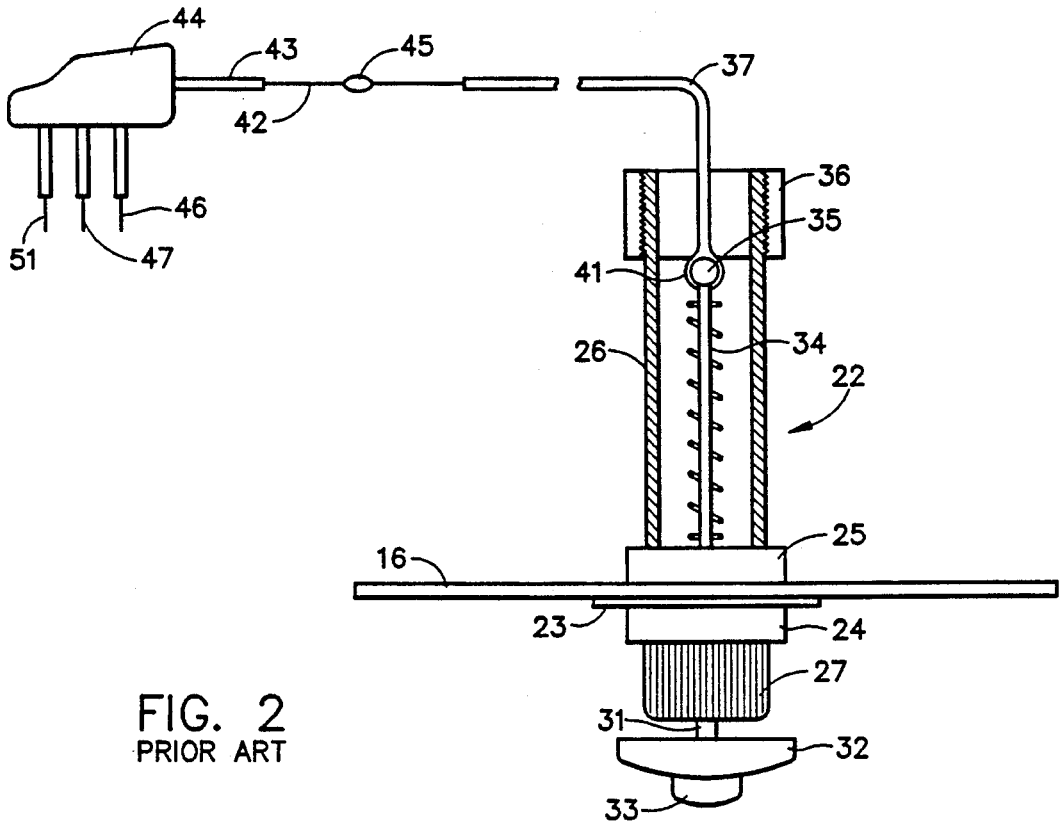
FIG. 2 PRIOR ART
FIG. 2 shows a mechanical vernier throttle control in a prior art configuration.

The prior art throttle control is shown in FIG. 2 comprising mechanical vernier throttle control 22, more commonly referred to as a Morse throttle control, which is mounted in control panel 16. The normal mounting would include washer 23 on the outside of the panel, nut 24 outside washer 23 and interior nut 25 securing housing 26 firmly to panel 16. Externally of nut 24 is drag lock 27; through all of the previously identified components extends stem 31 capped by control knob 32. In the center of the control knob is release button 33 which enables quick release of the set position of the Morse control. Extending inwardly from stem 31 and through nut 25 and centered in housing 26 is rod 34 having ball connector 35 on the inward end of the rod. The inward end of housing 26 is threaded, to which is connected sleeve nut 36.

Sheathed cable 37 is connected by ball engaging means 41 and extends for some distance, which may be up to 16 feet, from the end of the Morse control to connect with cable 42 extending through sheath 43 from potentiometer 44. The connector may be any appropriate mechanical means or it may comprise a weld 45. Appropriate directing means for cable 37, such as pulleys or routing tubes, may be used and have not been shown. Connecting to potentiometer 44 are ground wire 46, position tap 47 and voltage wire 51. These are connected to electronic control 14.

In operation, rotation of control knob 32 counterclockwise will cause rod 34 to pull away from nut 36 on the inner end of housing 26, thereby pulling cable 37 and moving a movable element in a linear manner within potentiometer 44. This causes a change in the output of position tap wire 47, thereby changing, through electronic control 14, the RPM's of engine 15. Rotation of control knob 32 in the opposite direction will cause rod 34 to move inwardly toward nut 36, thereby releasing cable 37 and allowing the potentiometer to move back toward the normal position. Alternatively, release button 33 may be hit a sharp blow, such as with the hand, and immediate release of rod 34 and cable 37 is achieved, thereby immediately reducing the RPM's of engine 15. This is the nature of the mechanical vernier throttle control described.

Figure 3:
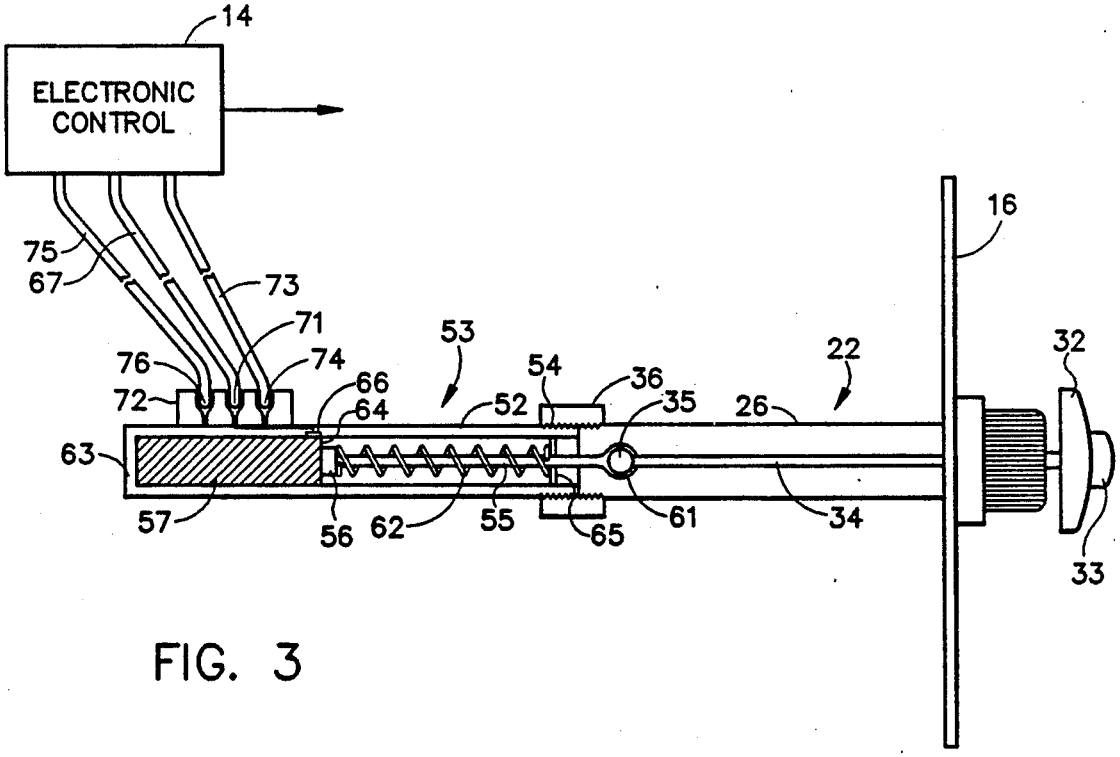
FIG. 3 shows the present invention.

In FIG. 3, the same Morse control mounted to panel 16 is used and it functions in the identical manner as that described above with respect to FIG. 2. On the inner end of housing 26 of the Morse control and coupled thereto by means of sleeve nut 36, is housing 52 of potentiometer 53, which is also formed with external threads 54 much like the external threads of housing 26 of the Morse control. Central rod 55 is connected through head 56 to movable core 57 of the potentiometer. The opposite end of rod 55 is formed with coupling means 61 to engage ball 35 at the inner end of rod 34. Rod 55 in housing 52 of the potentiometer is surrounded by coil spring 62 tending to maintain core 57 at the distal end 63 of the housing. One end of spring 62 bears against end 64 of core 57, while the other end of the spring is defined by plate 65 near the proximal end of housing 52. Position tap 66 is located on the inner surface of housing 52 and makes sliding contact with the coil of core 57. At the position shown, the minimal output of the potentiometer is transmitted to electronic control 14 by means of wire 67 coupled to contact 71 on outwardly projecting connector board 72. Wire 73 and contact 74 may provide the ground connection to the potentiometer while wire 75 and contact 76 may provide the input voltage. Of course, which of the leads provides which signal is subject to choice.

As control knob 32 is rotated to pull rod 34 outwardly from the position shown in FIG. 3, rod 55 of the potentiometer moves in the same direction, thereby moving core 57 toward panel 16 and compressing spring 62. This change of position increases the voltage of the signal being supplied to electronic control 14 through wire 67 and that signal continues to increase as core 57 is moved further and further toward control panel 16. When control knob 32 is rotated in the opposite direction, core 57 moves back toward end 63 of the housing, thereby providing a lower voltage signal to the electronic control. Of course, this change may be instantaneously achieved by hitting release button 33 as previously described.

Thus it can be seen that there is direct and positive control of the potentiometer which provides signals to the electronic control for immediate modification of engine speed through the mechanical vernier throttle control 22. It is possible that the potentiometer can be made without spring 62 since the linear motion of core 57 is positively controlled by the Morse control. As an alternative, the core may be held stationary within housing 52 and the tap may be moved along the side of the core by appropriate coupling to rod 55 and rod 34 of the Morse control. As another alternative, the potentiometer need not be straight linear, but it could be linear in an arcuate shape or it could provide a rotary motion by direct coupling to rod 55 if desired. The important thing is that there is a direct connection between the positive acting Morse control and the position varying aspects of the potentiometer.

In view of the above description, it is likely that modifications and improvements will occur to those skilled which are within the scope of the accompanying claims.

What is claimed is:

1. An electronic control adapter for a mechanical hand throttle control mounted to a control panel remote from and used with an electronic control for electronically controlled engines, said adapter comprising:

a mechanical vernier throttle control unit for converting rotational motion to linear motion, said control unit being mounted to the control panel and having an elongated control unit housing extending inwardly from the control panel and having an elongated control element extending through said housing, said control element being selectively linearly movable; and a potentiometer comprising:

a housing coupled to said control unit housing;

a winding core positioned within said housing;

means for applying a predetermined voltage to said core;

means for electrically tapping off an electrical signal from said core said tapping means being connected to said electronic control;

means for moving said winding core and said tapping means with respect to each other; and means for coupling said control element to said moving means so that movement of said control element comprises relative linear movement of said core and said tapping means, thereby changing the electrical signal coupled from said core to said electronic control.

2. The electronic control adapter recited in claim 1, wherein said winding core is movable within said housing and with respect to said tapping means between a minimum signal position and a maximum signal position.

3. The electronic control adapter recited in claim 2, wherein said elongated control element of said control unit is directly coupled to means connected to said winding core for movement thereof.

4. The electronic control adapter recited in claim 3, wherein said movement means comprises a rod connected at one end to said winding core and the other end is coupled to said control element.

5. A method for providing electronic control signals to an electronic control module for electronically controlled engines, said method comprising the steps of:

connecting in a panel remote from the electronic control a mechanical vernier throttle control unit for converting rotational motion to linear motion;

connecting a potentiometer to said control unit with the linear motion means of the control unit being connected to the movable element of the potentiometer to cause relative motion between the winding core of the potentiometer and the electrical tapping means thereof; and coupling the electrical signal from the tapping means to the electronic control module to enable the speed of the engine to be varied electronically through the mechanical motion of the vernier throttle control.

* * * * *